United States Patent [19]

Kimbrough

[11] 4,356,845

[45] Nov. 2, 1982

[54] HOLDING AND NOTCHING TOOL FOR CRT IMPLOSION PROTECTION

[75] Inventor: Laurence B. Kimbrough, Lititz, Pa.

[73] Assignee: RCA Corporation, New York, N.Y.

[21] Appl. No.: 200,538

[22] Filed: Oct. 24, 1980

[51] Int. Cl.[3] ..... B21F 9/00

[52] U.S. Cl. ..... 140/93.2; 100/32; 269/238

[58] Field of Search ..... 140/93 R, 93.2, 93.4, 140/123.5, 123.6; 100/32; 269/238

[56] References Cited

U.S. PATENT DOCUMENTS

| | | | |
|---|---|---|---|
| 3,396,760 | 8/1968 | Kirsinas et al. | 140/93.4 |
| 3,791,420 | 2/1974 | Beach | 140/93.2 |
| 4,110,877 | 9/1978 | Bracht et al. | 100/32 |
| 4,154,158 | 5/1979 | Leslie et al. | 100/32 |
| 4,160,510 | 7/1979 | Wardell | 220/2.1 A |

*Primary Examiner*—Lowell A. Larson

*Attorney, Agent, or Firm*—Eugene M. Whitacre; Dennis H. Irlbeck; Lester L. Hallacher

[57] ABSTRACT

A tool for holding and notching a banding strap being applied to an article includes angularly disposed pivotable arm. A fluid actuating device simultaneously pivots the arms in opposite directions. Each of the arms has jaws to hold the end of the strap by the edges before tension is applied to the strap and cutting edges to notch the strap to prevent strap motion while tensioning is being applied. Each of the arms also includes a fluid actuating device for rotating the notching edges with respect to the holding jaws.

15 Claims, 7 Drawing Figures

HOLDING AND NOTCHING TOOL FOR CRT IMPLOSION PROTECTION

BACKGROUND OF THE INVENTION

This invention relates generally to banding articles and particularity to implosion protection of a cathode ray tube (CRT) and to a tool for applying such protection.

In the operation of a CRT an electron beam travels the length of the tube from an electon gun to a phosphor screen to produce a visual output and accordingly such tubes must be evacuated. Atmospheric pressure therefore tends to collapse, or implode, the envelope creating a potentially hazardous condition. It has been learned that the hazards of implosion can be substantially decreased, or eliminated, by applying a tension around the envelope between the screen and the seam where the screen and the funnel and screen are joined. Various techniques of implosion protecting CRT envelopes therefore have been tried.

One common and successful method of implosion protecting CRT's consists of applying a tensioned metal band, or strap, which is completely wrapped around the faceplate panel, or end cap. In applying such a band, the band is wrapped, or looped, around the envelope so that the band overlaps itself. A metal clip is slipped over the double layered band and the inner free end firmly held while the other end is pulled into a tension. After the proper tension is applied, such as 1,500 pounds (675 kilograms), the clip and both layers of the metal band are crimped, the tensioning device is released and the untensioned portion of the band is cut loose near the clip. Because of the crimping together of the clip and the layered band, the tension remains in the portion of the band which is looped around the envelope. This technique of applying tension is successful in greatly reducing or eliminating the hazards of envelope implosion. However, several problems arise because the instrument, which is used to hold the free end of the band while the tensioning device applies the tension, must be inserted between the band and the tube envelope. For this reason, after the band is tensioned and clipped, the removal of the holding device results in the relaxation of some of the tension in the band. A common solution to the relaxation problem is to overtension the band so that the proper band tension permanently remains after the holding device is removed. This technique is not satisfactory because prior to the removal of the holding device the envelope is subjected to a higher than desired tension resulting in a potentially dangerous condition. Another problem arises in that the device which holds the inner end of the band while the tension is being applied must be sufficiently powerful to hold the end of the band against movement. The holding devices presently in use therefore are typically bulky thus increasing the need to over tension the bands. The invention is directed to a holding and notching tool which overcomes these difficulties.

The instant invention can be used in the system described in application Ser. No. (200,539) filed of even data herewith by Laurence B. Kimbrough et al and entitled "System For Applying and Tensioning An Implosion Protecting Band To A CRT With A Tension Between Selected Limits".

The instant invention can be used to produce the tensioning band described in application Ser. No. (200,141) filed of even data herewith by Laurence B. Kimbrough and entitled "Tensioning Band For CRT Implosion Protection".

SUMMARY OF THE INVENTION

A holding and notching tool for applying a banding strap to an article has a support which is moveable into the proximity of the article. Pivotable arms are supported by the support in an angular disposition with respect to one another. Each of the arms includes holding means for preventing movement of the end of the strap before tension is applied to the strap. Each of the arms also includes notching means to notch the strap and avoid movement of the end of the strap while tension is being applied to the strap. The tool also includes a means for pivoting the arms so that the holding means pivot towards each other. The notching means are rotated by another means to form notches in the strap and to hold the strap against movement while tension is being applied.

DETAILED DESCRIPTION OF THE PREFERRED EMBODIMENT

Figure 1:
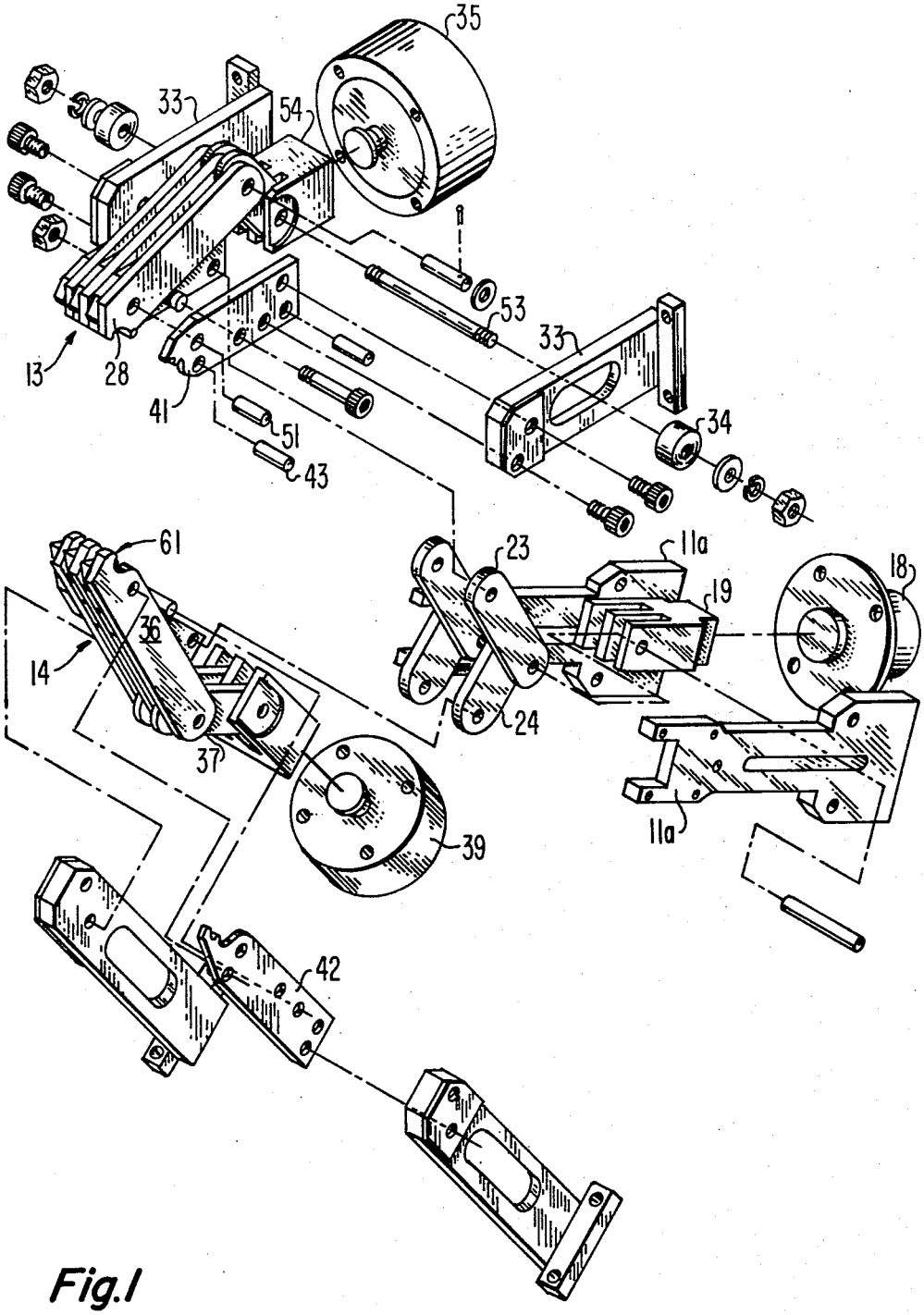
FIG. 1 is an exploded view of the preferred embodiment.
Figure 2:
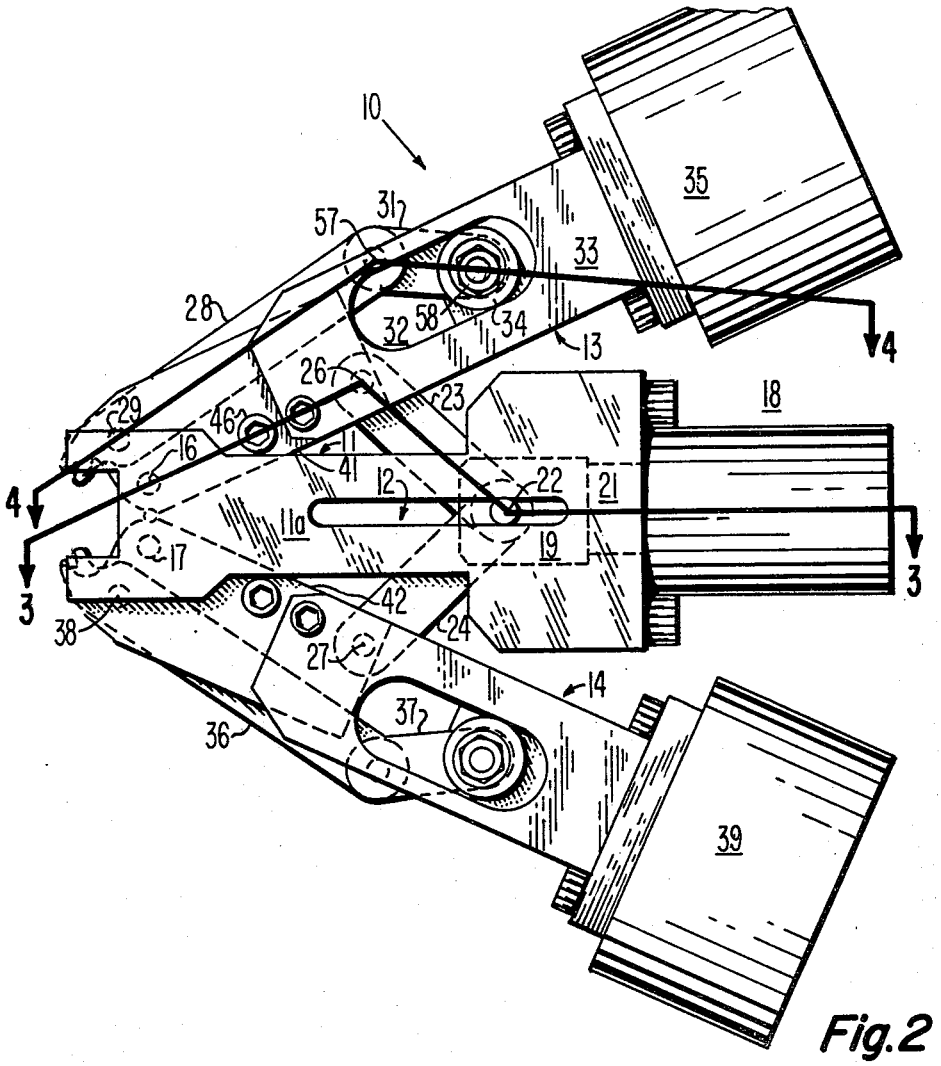
FIG. 2 is a side view of the preferred embodiment.

As shown in FIGS. 1 and 2, a holding and notching tool 10 includes a support 11 having a centered longitudinal slot 12. A pair of identical arms 13 and 14 are attached to the support 11 to pivot with respect to the support about two pivot axes 16 and 17, respectively. A fluid actuated device 18, which can be an air, hydraulic or other fluid actuated cylinder, is affixed to one end of the support 11. Upon actuation of the fluid device 18, a lug 19, which is attached to the fluid device 18 by way of a shaft 21, moves longitudinally with respect to the support 11 along the slot 12.

Rotatively coupled to the lug 19 at a pivot axis 22 are two actuating bars 23 and 24. The bars 23 and 24 are respectively coupled to the arms 13 and 14 at two pivot axes 26 and 27. Accordingly, actuation of the cylinder 18 causes the lug 19 to move longitudinally along the support 11, thereby opening and closing the bars 23 and 24 to pivot the arms 13 and 14 about the pivot axes 16 and 17, respectively.

The arm 13 includes a notching member 28 one end of which is rotatably coupled to the arm 13 at an axis 29. The other end of the notching member 28 is rotatably connected to one end of an actuating bar 31. The other end of the actuating bar 31 is arranged to slide on a roller member 34 in a slot 32 contained within a side plate bar 33, which is a part of the arm 13. The roller 34 is coupled to another fluid actuated device 35, such as a pneumatic or hydraulic cylinder. Actuation of the device 35 causes the roller member 34 to roll within the slot 32 resulting in the rotation of the notching member 28 with respect to the arm 13 about the axis 29.

The arm 14 is identical to the arm 13 and includes a notching member 36 arranged to rotate about an the axis 38 when a connecting bar 37 is actuated by a fluid device 39, which is identical to the fluid device 35, carried by the arm 13. The arms 13 and 14 also include holding members 41 and 42 which are respectivity pivotally coupled to the support plate 11*a* of the support 11 at the axes 16 and 17.

The notching member 28 is rotatably coupled to the holding member 41 which in turn is pivotally coupled to the support 11. Accordingly, actuation of the fluid device 18 causes the bar 23 to move so that both the holding member 41 and the notching member 28 simultaneously rotate as the arm 13 pivots about the axis 16. However, actuation of the fluid member 35, which is carried by the arm 13, causes the notching member 28 to rotate about the rotation axis 29 while the arm 13 and the holding member 41 remain stationary.

Figure 3:
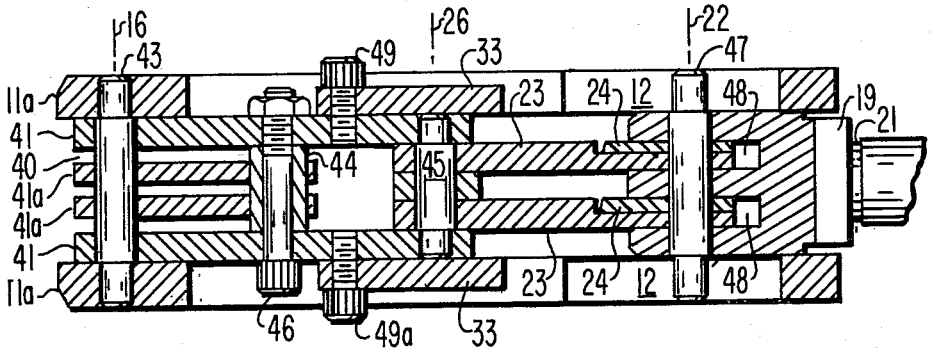
FIG. 3 is a cross section taken along line 3—3 of FIG. 2.

As shown in FIG. 3, two spaced parallel side plates 11*a* are included in the support 11. Two holding members 41 are juxtaposed the side plates 11*a* and two additional, but shorter, holding members 41*a* are spaced between the holding members 41. As explained hereinafter, the holding members 41 and 41*a* are separated by spaces 40 which receive a plurality of the notching members 28. The side plates 11*a*, and the holding members 41 and 41*a* are held together by a pin 43 which is centered about the pivot axis 16. A sleeve 44 passes through the other end of the holding members 41*a* to retain the spaced relationship of the holding members 41 and 41*a* and to retain the side plates 11*a* at the desired spacing. A coupling means 46, such as a bolt and nut, permanently hold these relationships.

The other end of the longer holding members 41 is arranged between the two identical side plates 33. This end of the holding members 41 rotatably receives a pin 45 which is centered about the rotation axis 26. The pin 45 also is received by one end of the two actuating bars 23. The other end of the actuating bars 23 (and also the actuating bars 24 which are coupled to the arm 14) receives a pin 47 which is centered on the axis 22. The pin 47 also passes through the lug 19 which contains clevises 48 to accommodate the actuating bars 23 and 24. The ends of the pin 47 slide within the slots 12 of the side plates 11*a* when the fluid device 18 is energized.

Figure 4:
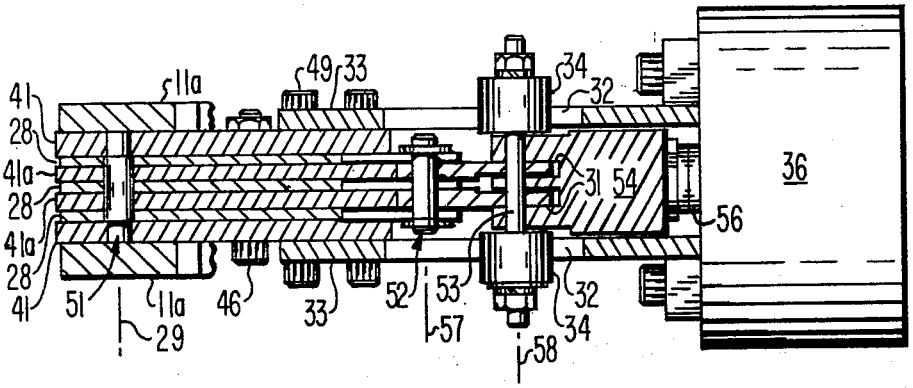
FIG. 4 is a cross section taken along line 4—4 of FIG. 2.

FIG. 4 shows how the notching members 28 are arranged in the spaces 40 between the holding members 41 and 41*a*. A pin 51 passes through the holding members 41, 41*a* and the notching members 28 at the axis 29. The pin 51 has a length identical to that of the sleeve 44 (FIG. 3) to hold the side plates 11*a* apart by the desired spacing. The other end of the notching members 28 rotatably receives a pin 52 which also passes through one end of the actuating bars 31. The other end of the actuating bars 31 rotatably receive the shaft 53 which also is received by a lug 54. The shaft 53 also passes through the rollers 34. The lug 54 is coupled to the shaft 56 of the fluid device 35 to slide between the two side plates 33 as the rollers 34 roll in the slots 32 upon actuation of the fluid device 35. This sliding of the lug 54 causes the notching members 28 to rotate with respect to the holding member 41 and 41*a* about the pin 51.

Figure 5:
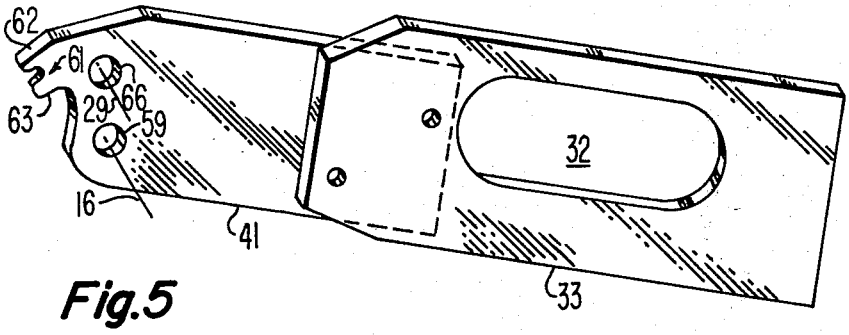
FIG. 5 is a detailed showing of the holding means.

FIG. 5 is a perspective of one of the holding members 41 and shows how all the holding members 41 and 41*a* are configured on the holding end to hold a strap prior to being notched by the notching members 28. The holding end includes a U-shaped portion 61 having one leg 62 which is shorter than the other leg 63. The difference in lengths permits the leg 62 to rotate over the strap to be held so that the bight of the U rests against the edge of the strap. The spacing across the inside surfaces of the legs 62 and 63 is slightly greater than the thickness of the strap. The inside surface of the leg 63 is flat so that the strap rests against and is supported by this surface when the notching members 28 engage the strap to form notches in the strap. The hole 59 receives the pin (FIG. 3) 43 so that the holding member 41 pivots with respect the support 11 about the axis 16.

The holding members 42 of the arm 14 are identically configured to the holding members 41 of the arm 13. As shown in FIG. 2, the arms 13 and 14 are arranged so that the bights of the U-shaped ends face one another. Accordingly, when the shaft 21 moves toward the axes 16 and 17 the bights of the U-shaped ends close toward one another. The pivot axes 16 and 17 are spaced so that the bights of the U-shaped ends firmly engage the edges of the strap to be tensioned and hold the strap without deforming or bending it.

Figure 6:
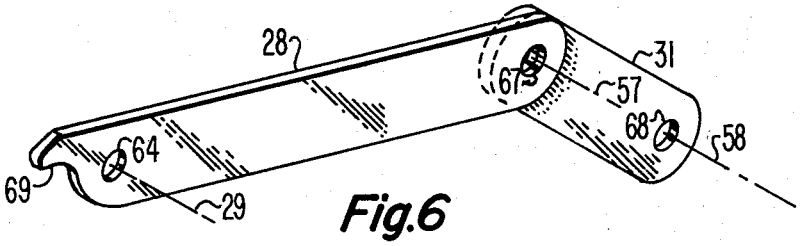
FIG. 6 is a detailed showing of the notching means.

FIG. 6 is a perspective of one of the notching members 28 and shows how all of the notching members 28 and the actuating bars 31 are configured and coupled together. The notching members 28 include a hole 64 which receives the pin 51 (FIG. 4) so that the notching members rotate with respect to the holding members 41 about the axis 29. The hole 64 is aligned with the hole 66 within the holding members 41 and the hole 66 also receives the pin 51. Another hole 67 passes through the notching members 28 and the actuating bars 31 to receive the pin 52 (FIG. 4). The other end of the bar 31 includes a hole 68 which receives the pin 53, also shown in FIG. 4. The end of the notching member 28 which is closest to the rotation axis 29, is formed into a point having a cutting edge 69 which is used to form notches in the strap prior to the application of tension to the strap.

Figure 7:
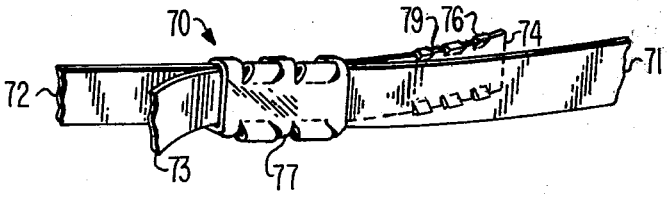
FIG. 7 shows a completed notched and crimped band formed utilizing the preferred embodiment.

FIG. 7 is useful in understanding how the invention operates. Two broken-away ends 71 and 72 actually are connected to form a loop which passes around the CRT to be implosion proofed. The other broken-away end 73 is connected to the supply of straping material and is that portion of the strap to which a tension applying device would be connected. The remaining inner end 74 is held by the holding and notching tool of the instant invention to prevent the end 74 from moving relative to the envelope while tension is applied to the end 73.

In operation, the end 74 of the strap is placed in the proximity of the envelope to be implosion proofed. The inventive holding-notching tool is either manually or automatically moved into the proximity of the strap so that the end 74 lies between the U-shaped ends 61 of the holding members 41 and 42. The fluid device 18 is actuated and the lug 19 moves toward the axes 16 and 17 so that the arms 13 and 14 rotate outwardly away from the support 11 causing the bights of the U-shaped ends to close toward one another and engage the edges of the end 74 of the strap. The fluid devices 36 and 39 are actuated and the notching members 28 and 35 rotate about the axes 29 and 38 respectively. This rotation brings the cutting edges 69 of the notching members into contact with the surface of the strap which faces the CRT. Upon initial contact between the cutting edges 69 and the strap 70, the strap 70 is pushed against and thus supported by, the flat inside surface of the long leg 63 of the holding members 41. Continued rotation of the notching members 28 and 36 causes the cutting edges 69 to form the notches 76 in the end 74 of the strap. The forming of the notches 76 results in the formation of the tabs 79 which are left by the notching. These tabs jut out between the two sections of the strap so that the immediately adjacent overlapping end 71 of the strap 70 does not rest against the CRT envelope after the holding and notching tool is removed. This is advantageous because the relaxation of tension is substantially reduced. The rotation of the notching members 28 and 36 is restricted so that the pointed ends of the notching members remain in the notches 76 and the tabs 79 remain between the two portions of the strap. The ends 61 of the holding members 41 and 42 continue to firmly grasp the edges of the strap between the notches 76 and the pointed ends remain in the notches. Accordingly, as tension is applied to the strap the inner end 74 cannot move with respect to the CRT. The primary holding ability is obtained from the action of the notches 76 against the sides of the cutting edges 69. Therefore, a modification can be made to allow for required increases in tension simply by increasing the number of notching elements 28. The depth of the notches 76 also affects the maximum tension which will be held. Therefore, increases in required tension also can be accommodated by increasing the stroke of the cylinder 35. Preferably, the depth of each notch is about 6% to 8% of the band width. After the desired tension is applied, a clip 77 of known type, is crimped to hold the tension in the strap. The tensioning device is removed and the end 73 of the strap is separated from the supply roll. It should be noted that because the short leg 62 of the U-shaped end of the holding members 41 and **41*a* is thin the space between the strap and the envelope required to accommodate the tool is minimized. Accordingly, overtensioning of the strap in order to have a residual tension of 1500 pounds after the holding tool is removed is minimized. After the tension is removed the fluid actuators 35 and 39 are moved in the opposite direction so that the cutting edges 69 are no longer in contact with the strap and the actuator 18 then is used to pivot the arms 13 and 14 inwardly toward the support 11 to remove the ends 61 of the holders 41** from contact with the strap.

What is claimed is:

1. A holding and notching tool for use with a system for applying a banding strap to articles comprising:

support means moveably arranged for selective positioning in the proximity of said strap and said article;

a plurality of arms pivotably supported by said support means and angularily disposed with respect to each other;

each of said arms including means for holding said strap to prevent relative movement of the end of said strap, said article and said support means prior to the application of tension to said strap, and means for notching said strap to prevent relative movement of said end of said strap, said article and said support means during the application of tension to said strap;

means for pivoting said arms to pivot said means for holding to move in a closing direction and hold the edges of said end of said strap; and means for rotating said means for notching relative to said means for holding to form notches in said end of said strap.

2. The tool of claim 1 wherein said means for holding includes a U-shaped end arranged so that the bight of the U engages one edge of said strap.

3. The tool of claim 2 wherein said means for notching include a cutting protrusion for cutting a notch into said strap.

4. The tool of claim 3 wherein there are a plurality of said means for holding and a plurality of said means for notching alternately stacked together so that said means for notching are rotatable with respect to said means for holding.

5. The tool of claim 4 wherein said means for pivoting includes a fluid actuated cylinder coupled to said arms to simultaneously move said arms.

6. The tool of claim 5 wherein said cylinder includes a clevised lug and further including bars pivotably coupling said arms and said lug.

7. The tool of claim 6 wherein said means for rotating includes fluid cylinders for rotating said means for notching with respect to said means for holding.

8. The tool of claim 7 wherein said fluid cylinders are movable along with said arms.

9. The tool of claims 2 or 4 wherein said arms are arranged on said support means with said U-shaped ends facing one another and wherein said means for holding are spaced so that the bights of the U's engage the edges of said strap when said arms are pivoted inwardly by said means for pivoting.

10. The tool of claim 9 wherein said U-shaped end includes a short side to enable said U-shaped end to receive said strap and a long flattened side to support said strap when said means for notching engages said straps.

11. The tool of claim 3 wherein said means for notching includes a blade member with said cutting protrusion at one end, said one end being rotatably coupled to said means for holding, and a bar for coupling the other end of said blade to said means for rotating.

12. The tool of claim 9 wherein there are two of said arms pivotably supported by said support means to pivot in the same plane.

13. The tool of claim 12 wherein said support means includes slotted parallel plates arranged on opposite sides of said arms.

14. The tool of claim 13 wherein said means for rotating includes a fluid actuated cylinder having a clevised lug pivotably coupled to said arms to simultaneously pivot said arms in opposite directions.

15. The tool of claim 11 wherein said protrusion is dimensioned to match said strap to a depth of about 6% to 8% of the width of said strap.

* * * * *